United States Patent [19]

Champion, III et al.

[11] Patent Number: 4,812,843

[45] Date of Patent: Mar. 14, 1989

[54] TELEPHONE ACCESSIBLE INFORMATION SYSTEM

[76] Inventors: C. Paul Champion, III, 871 Coachway, Annapolis, Md. 21401; Robert W. Libero, 2226 Coppersmith Sq., Reston, Va. 22091; Walter J. Palmer, 12210 Waples Mill Rd., Oakton, Va. 22124

[21] Appl. No.: 84,439

[22] Filed: Aug. 11, 1987

Related U.S. Application Data

[63] Continuation-in-part of Ser. No. 45,473, May 4, 1987, abandoned.

[51] Int. Cl.[4] ..... G08G 1/12; G08G 1/09

[52] U.S. Cl. ..... 340/905; 340/989; 340/993; 364/436; 364/424.01

[58] Field of Search ..... 340/993, 989, 990, 905; 364/424, 436; 379/58, 59

[56] References Cited

U.S. PATENT DOCUMENTS

| | | | |
|---|---|---|---|
| 3,845,289 | 10/1974 | French | 340/996 |
| 3,876,980 | 4/1975 | Haemmig et al. | 455/11 |
| 4,009,375 | 2/1977 | White et al. | 364/424 |
| 4,301,506 | 11/1981 | Turco | 364/436 |
| 4,305,970 | 9/1982 | Von Tomkewitsch | 364/436 |
| 4,554,418 | 11/1985 | Toy | 379/88 |
| 4,601,011 | 7/1986 | Gryberg | 379/95 |
| 4,654,482 | 3/1987 | DeAngelis | 379/95 |
| 4,700,378 | 10/1987 | Brown | 379/95 |

OTHER PUBLICATIONS

Mikami et al., "Comprehensive Automobile Control System", NEC Research & Development, No. 52, Jan. 1979, pp. 1-10.

*Primary Examiner*—Jin F. Ng
*Assistant Examiner*—David H. Kim
*Attorney, Agent, or Firm*—Dowell & Dowell

[57] ABSTRACT

A traffic information system which is directly accessed by individual subscribers by telephone, mobile telephone or computer wherein the subscriber will have the option of receiving reports of updated information by way of telephone, mobile telephone, personal computer or personalized pager. The system provides information concerning the current status of traffic conditions along specific commuter routings and/or other information which may be of interest to a subscriber including airline flight and related travel and stock information, generalized routing information as in the form of directions to particular locations, stock activity and the like. Upon the subscriber's demand, the system continuously monitors selected routings or other information and automatically provides the subscriber with updated information concerning changes in status or conditions.

19 Claims, 4 Drawing Sheets

TELEPHONE ACCESSIBLE INFORMATION SYSTEM

CROSS REFERENCE TO RELATED APPLICATIONS

This application is a continuation-in-part of applicants' abandoned U.S. application, Ser. No. 07/045,473 filed 05/04/87 and entitled Telephone Accessible Information System.

BACKGROUND OF THE INVENTION

This invention is generally directed to telephone and computer accessible information systems for providing subscribers with continuously updated information regarding a variety of subjects or topics of interest. In a preferred embodiment, the invention is directed to a traffic information system for advising travelers of conditions along vehicular routings in metropolitan areas and more specifically to a traffic information system which may optionally transmit information directly to subscribers by way of telephone, mobile telephone, computers and personalized pagers. The system is designed to enable subscribers to immediately obtain specific and updated information utilizing analog or digital communication equipment or combinations of equipment. The system is further designed to continuously monitor various conditions such as the conditions along various vehicular routings and automatically initiates call-back information to a subscriber's telephone, computer or digital pager in the event any significant changes in conditions have developed. In alternative embodiments, information such as airline, train and bus schedule information, stock market activities, news reports, specific directions and related travel information may be made available to a subscriber. Further, once a subscriber has accessed the system, update or response information may be selectively transmitted to a subscriber's personal computer, telephone and/or alpha numeric pager.

2. History of the Related Art

One of the major and evergoing problems in metropolitan areas is the overcrowding of streets and highways due to increased commuter traffic. Anyone whose has ever lived, worked or traveled through a major urban area during the primary commuting or rush hours has experienced the frustration and exhaustion of bumper-to-bumper stop and go traffic conditions. A single mishap or accident along a major arterial road or highway can create hours of delays in commuter travel time and may effect thousands of motorists.

The problems associated with commuting in major city areas not only causes immense emotional and physical frustration for those immediately affected by the long delays but also takes its toll in increasing the potential risk of additional accidents and/or injuries. Further, such delays increase automobile emissions which adversely effect the quality of air and the environment. Some psychologists have said that the daily stress of commuting can lead to reduced work productivity, strained family relationships, and heart disease. Such delays also account for losses in business revenues due to reduced employee work time, missed appointments and the like.

In an effort to alleviate the commuter traffic problem, cities and local governments have begun spending large revenues to build or expand mass transit systems including expanded bus and commuter rail services. Unfortunately, most transit systems cannot and have not been totally effective in alleviating the traffic problem associated with traveling along urban area highways during peak use hours. In more recent efforts to monitor highway traffic conditions, city, state and local governments have begun utilizing video surveillance systems, electronic traffic detection devices as well as increased traffic reporters and spotters both along highways and in the air. Using continuously updated traffic information, local authorities are attempting to respond more quickly to exigent conditions which can cause major traffic back-ups such as accidents, breakdowns or faulty traffic control including stoplights or ramp control lights along major arterials.

Government monitoring and control of traffic conditions are helpful but not preventive of large traffic tie-ups. During peak travel hours, if traffic flow is interrupted for only a period of minutes, the resultant back-ups can create gridlock and cause hours of commuter delays in travel time. Realizing that commuters and not just government agencies are in need of local traffic information, commercial businesses have been created to provide such information to local television and radio broadcast systems. Such commercial businesses not only monitor information received from local governments, police, fire and rescue sources but also receive direct reports from individuals who travel the various commuter routings during peak or rush hours. The broadcasters barter the information which has been assembled and make it available to their listeners.

Because traffic information is one of the foremost concerns of many radio and television audiences, some stations further supplement information received from both commercial and government sources with their own traffic spotters both on the ground and in the air. Air traffic services enable broadcasters to receive and transmit reports of existing traffic conditions by low flying aircraft who can reach the scene of a traffic problem very quickly and without being delayed by local vehicular traffic. Unfortunately, an aircraft can only be in one area at a given time and in most metropolitan areas, it may take up to an hour or more to fly a complete circuit around the city. Also, aircraft reports are only possible when weather conditions permit aircraft to be in service.

The primary shortcoming of the presently utilized metropolitan traffic information systems is that they are not responsive to the traveler. The systems are necessarily limited to making generalized information available. Such information may be specific to certain groups of commuters using a common route or arterial in a given hour but are not effective in providing commuters on differing routes continuously updated information regarding the travel conditions to be expected along their routes or alternative routings. All too often, commuters await information by way of a chosen broadcast system relevant to their route, only to find that the reports are too late and they are already caught in time-delaying back-ups, or because conditions have changed moments after a traffic spotter or aircraft reporter has passed a given area, they are led to believe that their route is open and traffic moving smoothly only to find that they are now just one vehicle in an arterial parking lot.

Information systems have been proposed that will make traffic information directly available to specific vehicles. Some of these systems utilize central processing stations which transmit information to vehicles at given areas or locations. In U.S. Pat. No. 4,301,506 to Turco, a routing computer system is disclosed wherein a vehicle operator may utilize an onboard computer system to access data concerning routings between two points. The computer provides a visual read-out of directions to travel from one point to another. The system also includes circuitry which will provide or indicate alternative routings in the event a preferred route becomes blocked or tied-up. Unfortunately, such a system requires the use of a vehicle mounted computer having keyboard and video display equipment which are not only not practical but are not cost effective for individual commuters. Further, such systems are only designed to provide alternative route information in the event a back-up is encountered. There is no provision for updating or monitoring existing traffic conditions in order to provide information to avoid a particular route. In essence, the system is an electronic mapping data base which provides route designations between points but not present traffic conditions.

In U.S. Pat. No. 4,350,970 to Tomkewitsch, another traffic routing and information system is disclosed. In this system, stationary routing status transmission poles are used to monitor traffic flow and to transmit information concerning traffic conditions to passing vehicles. The system requires that passing vehicles to be equipped with equipment capable of transmitting travel time information between the fixed pole locations in a given vicinity. Such information is then utilized to evaluate traffic flow. Information from the fixed poles is transmitted to a central computer which then assembles the information and commands the fixed poles to transmit pertinent information regarding conditions ahead to vehicles approaching such fixed transmission poles. Again, such a system is not practical or cost effective. The expenses of providing fixed transmission poles along major arterials would be prohibitive. In addition, commuters will not have access to information being transmitted until they approach within transmitting range of fixed locations. Thus, a commuter will not be advised in advance of a given location of the traffic conditions further along the commuter routing.

As a result of the ever increasing traffic slow-downs and tie-ups which effect business travelers and commuters, many individuals and businesses have begun or increased the use of mobile telephone services to allow their business people to conduct business when caught in time-consuming delays along commuter routes. Although mobile phones and phone services have not provided the commuter with ways to avoid traffic delays, such services do permit savings in business time and revenues and also make it possible for necessary information or decision making to transpire regardless of travel delays to and from a place of business.

Some additional examples of vehicle guide and control systems which are proposed for automatically routing vehicles are disclosed in U.S. Pat. Nos. 3,845,289 to French and 4,009,375 to White et al.

SUMMARY OF THE INVENTION

This invention is directed to analog and digital information communication systems for providing subscribers with continuously updated information regarding a variety of subjects or topics of interest by way of telephone, personal computer and/or personal paging equipment. In a preferred embodiment, the invention is directed to a traffic information system which is initially accessible to subscribers by Touch-Tone or dual tone multiple frequency (DTMF) capable telephones or digitally, via modem. Each geographic or metropolitan area which is served by the system will be represented on a specially designed map which will illustrate major thoroughfares and a unique color coded grid system to represent roads that are not major thoroughfares. Using location coordinates and the codes used to designate major roads, a subscriber will select a desired route. These coordinates and codes will be represented to the system by way of a DTMF capable phone or digitally by way of a computer/modem link. Information from the system may be selectively transmitted by existing telephone and mobile telephone networks for receipt by subscriber's telephones or personal computers or by way of FM subcarrier modulation or existing commercial paging signal transmission networks for receipt by a subscriber's personal alpha numeric pager.

This system includes a central operations or control facility wherein information is received, interpreted and disseminated to subscribers of the service offered by the system. In supplying information in accordance with the preferred embodiment, local traffic information will be received from a variety of sources including existing government and commercial traffic watch services, police, fire and rescue reports and advisories, local radio and television broadcasts including on the spot or eye witness reports, fixed wing aircraft and helicopter airwatch services and the like.

All information being received at the operations control facility will be interpreted by coordinators to determine if such information alters the status along any of the predetermined routing areas. If any change has occurred which will effect traffic flow from a normally anticipated flow for a given area and, if the coordinator determines that a file update is necessary, the information will be immediately placed within the system to be accessed by or transmitted to subscribers.

The system includes a plurality of command nodes or communication channels which interface directly with telephone and/or mobile phone services and/or computers. Each node or channel will include a processing computer and a multi-line voice communication system which are interconnected to the system's central data file or fixed computer source which will retain information regarding subscriber information to thereby control either the acceptance or the transmission of incoming or outgoing information.

At the operations control center, the traffic information is filed and stored in multi-line voice communication systems which not only record messages relevant to selected routings but will dissiminate such information through the multi-line voice communication systems associated with each of the nodes or channels of the system. In the event of a change in a given routing, operators at the operational terminal will voice transmit such activity to the multi-line voice communication system which will in turn feed such information to the fixed or central data computer file source. From there, information is made available to the voice communication systems associated with each of the incoming channels or nodes. Upon the receipt of an incoming subscriber phone call, the voice communication system (VCS) will provide current information by way of audio transmission or digital transmission of traffic conditions at a predesignated area to subscribers whose identity has been properly assured by the computer network. Depending upon the service level desired by a given subscriber, the VCS of the system will automatic redial and transmit routing information to subscribers regarding changes in status along selected routings as determined by the central data computer file source. Subscribers to the system will have the option to request receipt of initial reports or update reports in either analog (telephone/voice) form or in digital (modem or pager) form.

The fixed, dedicated central data file computer or source will regulate which information is to be made available to a given subscriber. In a first level of service, subscribers may access information regarding one or more given routes which are identified by predesignated numbers which are coded into the computer through the subscriber's DTMF capable telephone or digitally by computer. Once the system has insured that the subscriber has identified themselves through an appropriate account, the system allows entry of a preselected number of route groupings. A voice or digital transmission is then allowed to be relayed from the VCS of the node or channel thereby alerting the subscriber to the conditions along the designated routes.

In a second level of service, the traffic information and status along the designated routings which have been requested by the subscriber are continuously monitored over a predetermined period of time with updates being automatically transmitted to the subscriber to alert the subscriber of changes in conditions along preselected routings. Transmission of updated information may be by way of telephone (voice) communication or digitally to a personal computer or pager. Transmissions to telephone and personal computers will be by way of existing telephone and mobile telephone systems while transmissions to pagers may be accomplished either over existing commercial paging systems or by way of FM subcarrier transmissions. An additional level of service would allow alternative routings to be selected with traffic conditions being reported for such alternative routings.

It is a primary object of the present invention to provide information for travelers in metropolitan areas which permits them to directly access and receive information regarding specific route designations which are identified by coded numbers which may be entered into the system by DTMF capable telephones or by digital means via modem and computer.

It is another object of the present invention to provide a traffic information service to commuters in metropolitan areas which permits commuters to obtain information regarding various travel routings directly by telephone, mobile car phone, computer or alpha numeric pagers so that the commuter will known the status of a given route and at the exact time which the commuter desires to travel such route.

It is a further object of the present invention to provide traffic information regarding specific routings directly to a subscribed wherein the subscriber will not only have immediate access to existing traffic conditions but wherein the service will automatically watch the conditions along the preselected routings and reestablish contact with the subscriber and inform the subscriber of any changes along such traffic routings so that the subscriber can take appropriate steps to avoid areas of congestion. Such a service enables the subscriber to automatically have access to the most up-to-the-minute information by the operations control computer system.

It is another object of the present invention to make traffic information directly accessible to subscribers in their own automobiles by way of mobile car telephones so that the subscriber may obtain updated information regarding traffic conditions without having to purchase additional radio, computer or other monitoring equipment.

It is another object of the present invention to provide an information system which can transmit reports and information to a subscriber's digital pager in either voice, LCD display or print modes.

It is also an object of the present invention to provide a relatively low cost service for travelers in urban areas wherein commuters, for a fixed fee, can obtain access to the most current up-to-the-minute information regarding traffic conditions along a given or preselected route over which the subscriber wishes to travel and which system has the capability of allowing the subscriber to select alternative routings and receive alternative information concerning such routings so that a decision can be made to either alter a normally traveled route in favor of a secondary route or delay departure time until the routing is clear.

It is another object of the present invention to provide a traffic information service which is accessible by subscribers wherein information is made readily available over telephone lines, mobile telephone systems, computer systems, pagers or other communications systems directly to the subscriber with the service being capable of updating information, redialing or contacting the subscriber and providing the subscriber with changes in information regarding preselected routes by utilizing existing phone, mobile phone, computer and pager communications systems.

Another object of the present invention is to permit subscribers to access continuously updated information by way of DTMF capable telephones, including mobile telephones, regarding numerous subject matters including travel industry schedules and related activities, travel routing information, news and stock reports and other areas which may be of interest and wherein reports may be received by telephone, personal computer or digital pager.

DESCRIPTION OF THE PREFERRED EMBODIMENT

With continued reference to the drawings, the invention will be described as it directly relates to commuter accessible traffic status service (TSS), however, other information which may be of interest to a subscriber S may be continuously monitored, updated and made readily available upon coded demand. The commuter accessible traffic status system (TSS) of the present invention is uniquely designed to be utilized or accessible through conventional telephone or mobile phone service carriers. This enables a subscriber S of the system to gain access to the information from the system by use of equipment that is already installed in the subscriber's home, business, or vehicle. This system is designed for access by DTMF signals, and therefore, the only requirement with respect to the subscriber's telephone service is that the equipment be capable of generating a DTMF signal such as available in most newer telephones. Further, the system permits a subscriber to optionally receive initial reports or updated information by way of call backs to a predesignated telephone, mobile phone, personal computer or digital paging device.

The traffic status system or service (TSS) will include an operations control center for each metropolitan or geographic area of operation. With respect to FIG. 2 of the drawings, the operations control terminal is designated generally at 10. At the operations center, information regarding traffic conditions is received by personnel who interpret the information and make decisions on whether or not traffic conditions along given routes have changed thereby requiring an input into the central data file 12 of the traffic status system (TSS). Information is received from local govenment sources including traffic control centers, police, rescue and fire transmissions as well as from commercially available sources including radio and television broadcasts and commuter information services. As previously discussed, other information may be likewise received, monitored and updated for access to subscribers. Such information may include long range travel routings both within and beyond a given service area, updated news, commodity and stock reports, airline, train and bus scheduling and other information which may be of interest to the subscriber.

Figure 2:
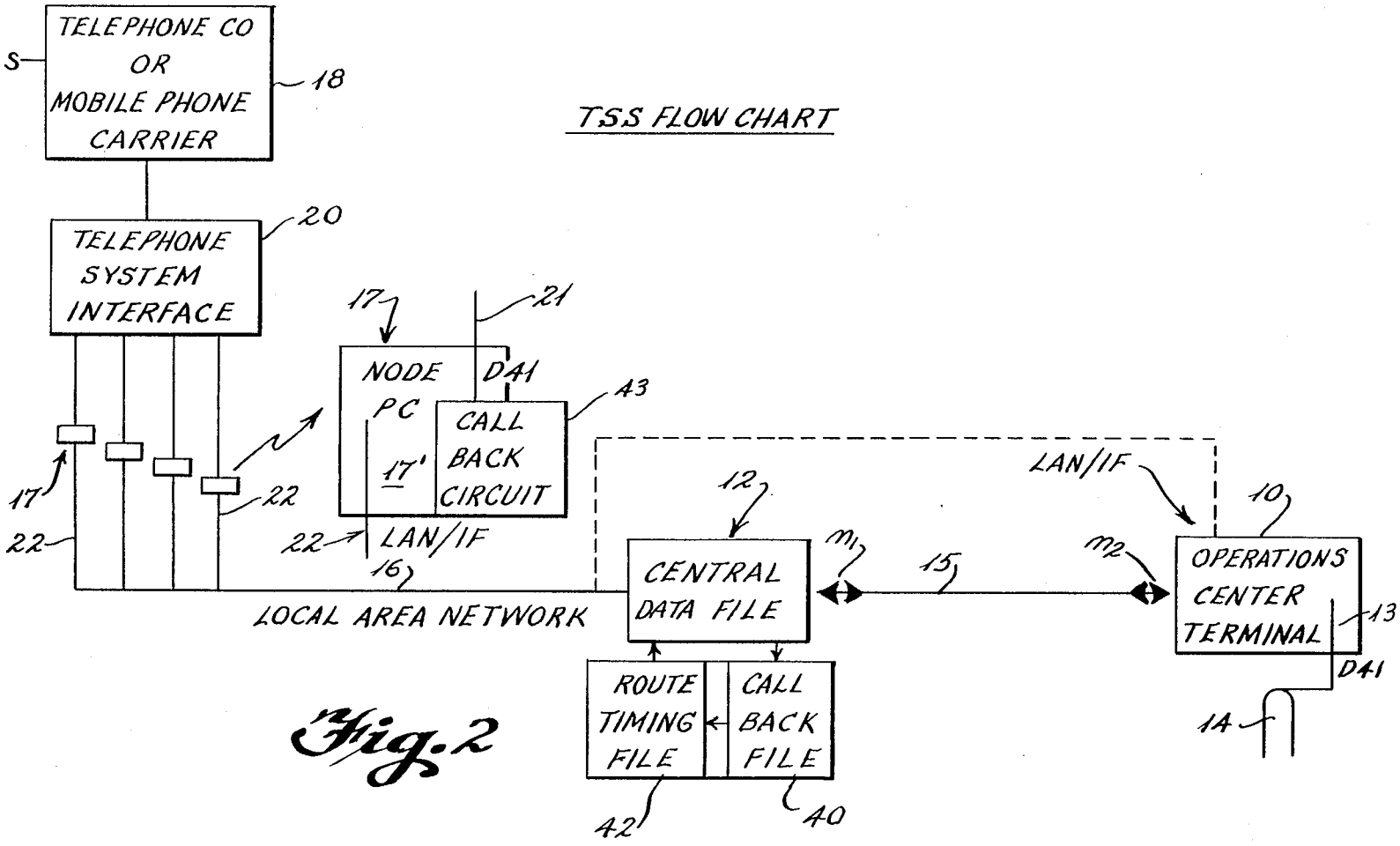
FIG. 2 is a diagram showing flow of information within the system as it is interfaced to a standard telephone or mobile telephone service facility showing an alternate or back-up system in dotted line.

Each terminal operator communicates with the central data file 12 of the traffic status system (TSS) by way of a multi-line voice communication system (D41) and as designated at 13 in the drawings. The voice communication system is directly accessible through a headset 14 which is worn by each operator. The voice communication system has the ability to record and play back speech and makes use of shared memory buffers and a high speed onboard microprocessor to support four independent communication interfaces and voice compression/expansion processors. Adapted differential pulse code modulation is utilized to minimize data storage and transfer requirements. At the operations control center, the voice communication system records information being spoken into the headset and creates a file which can be sent to the central data file or transmitted over a communication link 15 which extends from the operation control terminal to the central data file 12. As shown in FIG. 2, the connection between the operations terminal and the central data file may be made by a phone line connected by modems M1 and M2 positioned adjacent the central file and the operations terminal. As an alternative, and as shown in dotted line, the operations terminal may be directly connected to the central file by way of a local area network 16 which will be described hereinafter. In this manner, information which has been received by the voice communication system (D41) at the operations terminal is conveyed to the central data file computer where such information is selectively accessible by subscribers to the system.

To enable the operation control terminal to function in the designated manner, software programs will be responsible for performing tasks including recording new traffic or other information messages as entered by each operator from the headsets into the voice communication system (D41) units. When there is a message that needs to be updated, the operator records a new message which is entered through the headset into the (D41) and stored locally in the operations center terminal. The operator then plays back the message to determine that the message is accurate. Any corrections may be made at this time. The operator then sends the new message to the central data file via the local area network. The new message is recorded over the old message file. Confirmation of the message transmission is sent to the operator and displayed on the terminal.

For subscribers 5 to obtain access to the information stored in the central data file of the traffic status or other information system, the central data file computer 12 is connected by way of a local area communication network 16 through a plurality of separate communication channels or nodes 17 which communicate with the telephone company lines or through lines to a mobile telephone carrier as generally designated at 18. The interface is generally through a conventional telephone system interface 20 which will include the appropriate hardware for electrically connecting the nodes or channels to the telephone company or mobile phone carrier. Each of the separate channels or nodes 17 are designed to include a personal computer 17' which is linked with second multi-line voice communication system (D41) units 21 (of the type previously discussed) and hardware for linking the nodes to the local area network 16. The local area network interface 22 connects each nodes through the local area network with the central data file. In this manner, all phone calls both incoming and outgoing to the traffic status or other information system are handled by the separate nodes through the telephone system interface 20.

The voice communication system (D41) units 21 associated with each node 17 have the ability to play back such traffic or other information messages, i.e. travel schedules, stock reports and the like, as requested by a subscriber. The second (D41) units operate to decode incoming DTMF for the purposes of determining proper account number identification to authorize access to the system. The unit also recognizes the coded DTMF signals which represent given traffic routes or other information required as will be described in greater detail hereinafter. Such unit further provides an ability to automatically dial or call back subscribers who have requested updated information with regard to specific traffic routings or other information and once having made a connection on a call back plays the appropriate updated traffic or other messages as received from the central data file 12. In this respect, the (D41) unit of each node include circuitry which enables it is distinguish when a subscriber's phone is busy or out of service or that there is no answer so that either a decision is made to drop further effort to contact the subscriber or that continued efforts to redial a given subscriber to provide updated information will be continued.

Figure 1:
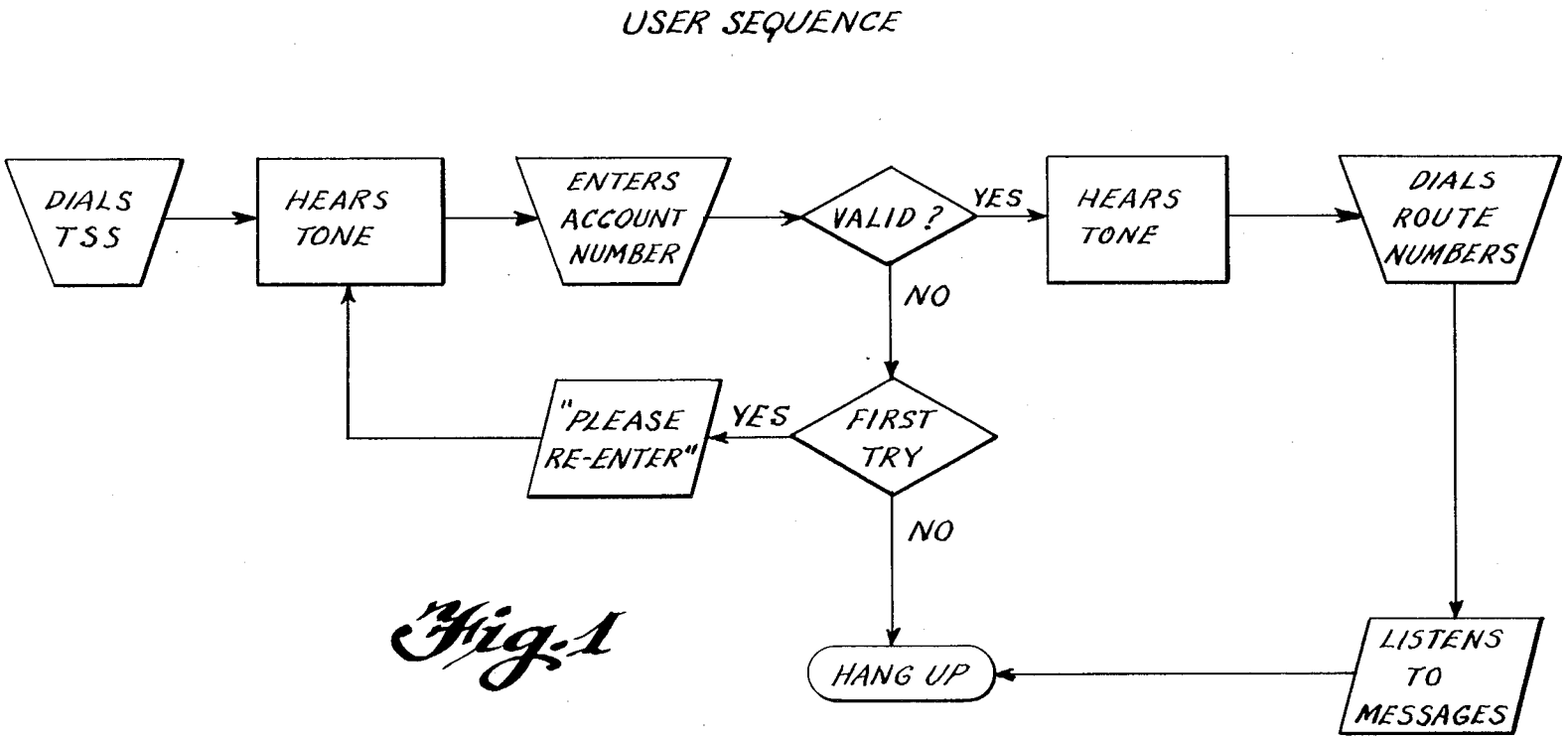
FIG. 1 is a sequence of subscriber entry into the system of the present invention.

In the operation of the separate channels or nodes of the traffic status or other information system, software programs will be provided to program the personal computers (PC) 17' at each station so that as incoming calls are taken, a subscriber is able to gain access only upon the entrance of a specific account number or access code. The (D41) units 21 will decode the DTMF pulses as entered by subscribers via telephone and will pass the data to the node's computer. The subscribers' access to the traffic status or other information system is disclosed in block diagram in FIG. 1.

The system is designed to allow a subscriber to touch dial into the system wherein the (D41) unit of a node receives the tones and decodes the account number which is transmitted by the subscriber. The DTMF pulses are converted to an ASCII String which is read by the computer software and a determination is made as to whether or not a valid entry number has been transmitted. If a valid entry number has been transmitted, a separate tone will be sounded to the subscriber through the (D41) unit. The subscriber will thereafter enter a series of numbers or designation codes which relate directly to predetermined routings or other information file codes. The system then provides information from the central data file 12 via the local area network 16 and interface 22 to each of the nodes 17. The nodes will then transmit such information by way of the (D41) units 21 to the subscriber. The subscriber will listen to the message relating to traffic conditions along the predesignated routes or will receive an update or other information made available through the system after which the unit will automatically disconnect the caller from the line. In order to oversee and regulate calls being made into the system, if a person enters an invalid number upon their first access to the system, they will be given a second chance to re-enter the proper code. Failure to enter the proper code on the second try will automatically result in a disconnect from the system as shown in the block diagram in FIG. 1.

After entering a valid account number, the subscriber selects the route or routings for which information is desired on by way of a set of location coordinates designated on the system's gridded map. Each geographic or metropolitan area which is served by the system will be represented on a specially designed map which will illustrate major thoroughfares and a unique color coded grid system to represent roads that are not major thoroughfares. Using location coordinates and the codes used to designate major roads, the subscriber will select a desired route. The subscriber enters the coordinates into the system by pressing the appropriate keys on the telephone. In a similar manner, predesignated key combinations will enable the subscriber to obtain other information service as disclosed previously. When traffic status service coordinates are keyed into the system, if the traffic status in all locations selected by the subscriber are normal, the subscriber will hear a message to that effect. If there are delays associated with one or more of the locations or commuter routings, the subscriber will be advised of the specifics and of the locations. In the event the subscriber has elected call back or traffic update service, the account number and the location coordinates of the chosen routings are stored in memory by the computer at each node location for future call back in the event the computer receives information from the central data file that the status has changed along any of the preselected routings. Similar call back information may be provided for other information services including stock, commodity or travel schedule reports.

In the event that a subscriber is to receive call back information, the programming which normally controls the incoming calls through the nodes into the system will be switched to a call back mode upon proper notification from the central data call back file 40. When the central data file receives a new message from the operating command or control terminal, the call back software File 40 associated therewith will initiate a call back and update sequence. The sequence begins by receiving the message from the operational control terminal and verifying the integrity of its receipt. After confirmation to the operational control terminal, the central data file receives all the call-in files which have been made to the various nodes which are in line through the local area network. The central data file will also transmit a new message file to each of the nodes. The call back software File 40 associated with the central data file will process all of the previous incoming calls received from the nodes and extract the calls made for selected information or traffic information with respect to the given routes which are affected by the newly received information from the operational command or control terminal. When traffic status information has been requested, the software will use the call-in time and the data will respect to a route timing file 42, as will be described in greater detail hereinafter, to eliminate those subscribers who have already passed through the route location. In this manner, the system will insure that only those subscribers who may be affected by the change in status of given routes will be notified of such changes. Once the processing has been completed by the central data file, the valid call back numbers will be issued to the nodes and the call back sequencing will be initiated through the D41 units which are associated with the nodes. The time routing file 42 will compare a subscriber's call-in time with an average travel time along the preselected routings to determine whether or not the subscriber should receive updated traffic information or whether the subscriber should have traveled beyond the affected area.

As the node receives the message in the form of a call back file from the central data file, the nodes computer software switches to a call back mode and the node computer instructs the D41 unit to begin a sequence of call backs through the call back circuitry 43 to users who have previously phoned in form information about the given commuter routes, locations or other information. Again, if a subscriber is unavailable in that the phone is busy or out of service, the software will keep the call in a queue for redialing at a later time.

As previously discussed, in the operation of the traffic status information service, each geographic area which is served by the system will be divided into predesignated routings or areas according to road and highway combinations which are commonly traveled. Each route will be given a numerical code and each subscriber to the system will be given a coded map from which to select when calling for traffic status information. Other codes will be provided for additional or other information services as previously discussed.

During operation of the traffic status information system, the level of service may be varied depending upon subscriber needs. As a basic form of service, subscribers would be able to call from their home, business or car telephones and for a set rate gain access to the node computers utilizing their assigned account numbers. Once into the computer system, the subscriber could thereafter enter one or more designated routing codes into the computer through the keyed numbers on their telephone and thereafter receive the status information with regard to the route number or grid coordinates selected. Once the information has been transmitted, the traffic information system would automatically release the call by disengaging the line at the incoming call node. As a second level of service, a record of an incoming call would be retained in memory within the incoming node with the identity of the subscriber and the time of initial entry of the call being maintained in the computer file. In addition, the node would also retain the designated route numbers of interest to the subscriber. Thereafter, if the central data file receives information from the operational control terminal that one of the routes selected by the subscriber has been effected by a change of status, the central data file would screen the time of the original call to determine if a call back notice is warranted. In the event that little time has elapsed since the initial inquiry into the system, the information will be transmitted by having the voice communication system D41 element of one of the transmission nodes redial and contact the subscriber and thereafter convey the updated traffic status information.

Additional levels of service could also be established. Increased numbers of route selections may be entered into the computer for processing and sequencing. Therefore, at a level one service, perhaps only one or two entries would be permitted per call. However, at higher levels, as many as four or more entries could be entered in sequence. Using the time control file which is associated with the central data file, the system would thereafter monitor the theoretical travel time of a vehicle through the sequenced identified travel zones or areas providing updated information at points where the time file indicates that the time elasped from the initial subscriber call would indicate that a call back notice is due in a second, third or fourth stage of the routing.

As a back-up to the failure of one of the nodes or as an alternative node source, the (PC) of the operations center terminal may be selectively placed into service through the local area network 16 through an interface LAN/IF as shown in dotted line in FIG. 2. In this capacity, the center terminal will function both to input status changes into the central data file and will also be capable of receiving subscriber inquiries and transmitting stored information.

The present system is designed to allow subscribers to have direct access to traffic information which involves or effects routings into metrolpolitan areas. The system is designed to operate on a pay by call basis or monthly fee basis depending upon the level of service. Access to the system would be through designated numbers with account numbers being assigned to each subscriber to permit entry into the data file of the system.

Figure 3:
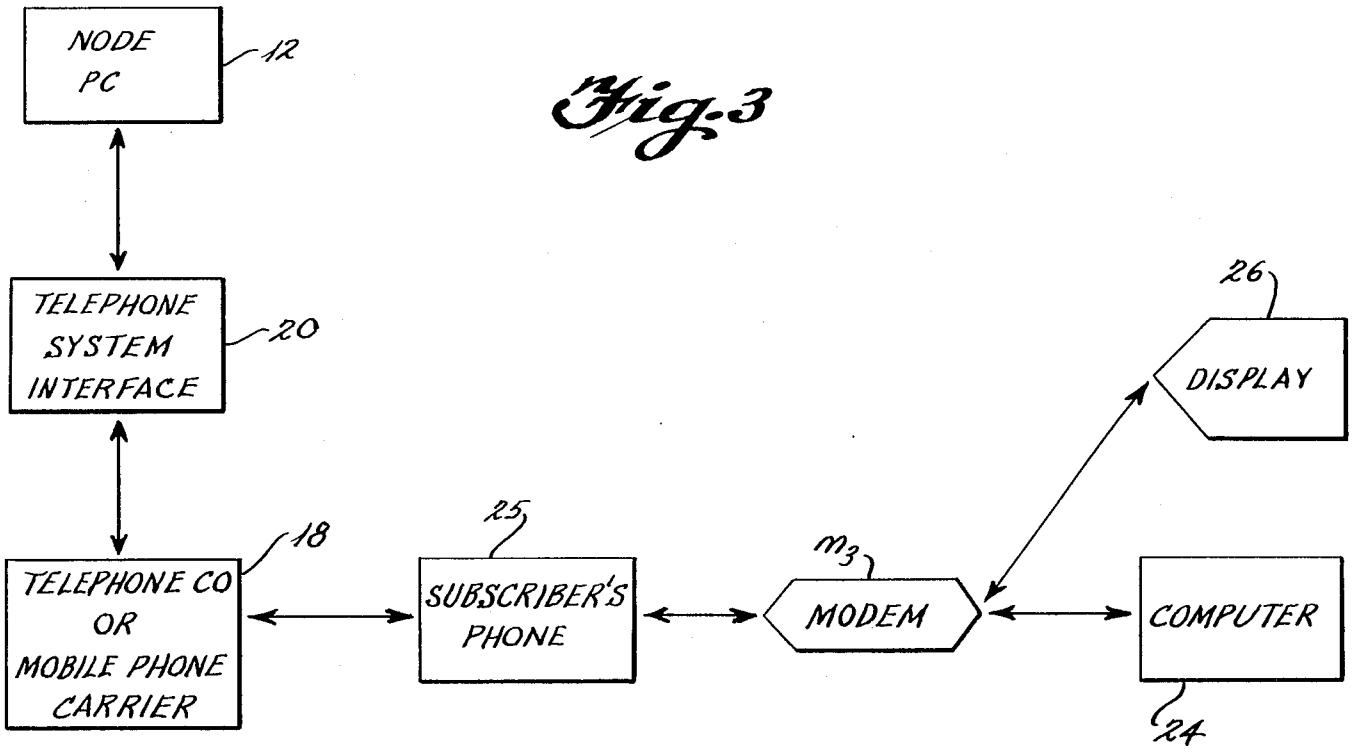
FIG. 3 is a diagram of the units necessary to establish a digital communications link in accordance with an alternate embodiment of the present invention to a personal computer.

With continued reference to FIG. 3 of the drawings, the invention will be described as it directly relates to an alternate and/or simultaneous method of transmitting and receiving information to and from the system. If the subscriber chose to access the information digitally i.e. in a non-analog manner, the system would be able to offer the same features as the previous embodiment. Accessing the information, however, would be different. As shown in FIG. 3, a subscriber will be able to access one of the computer nodes of the system by a computer 24 which may be a computer installed within an automotive vehicle. The computer is linked to the information system by way of an adjacent modem M3 which cooperates with the subscriber's telephone 25 to receive digital information from the information system computer nodes 17 by way of the telephone system interface 20 and telephone company or mobile phone carriers 18. The information received will thereafter be stored or displayed by way of a printer, display or computer CRT 26.

In order to access the information by computer, a subscriber would program their computer to do the following tasks automatically:

dial the phone number of the system;
enter the account number;
enter the codes or coordinates of the route(s) desired;
receive or 'download' the information into computer memory;
hang up;
display the requested information on the computer CRT or separate display.

This method would allow far less connect time with the system and permit the subscriber to save and/or store the information. This is especially beneficial to mobile telephone users since they are charged in fractions of a minute.

Figure 4:
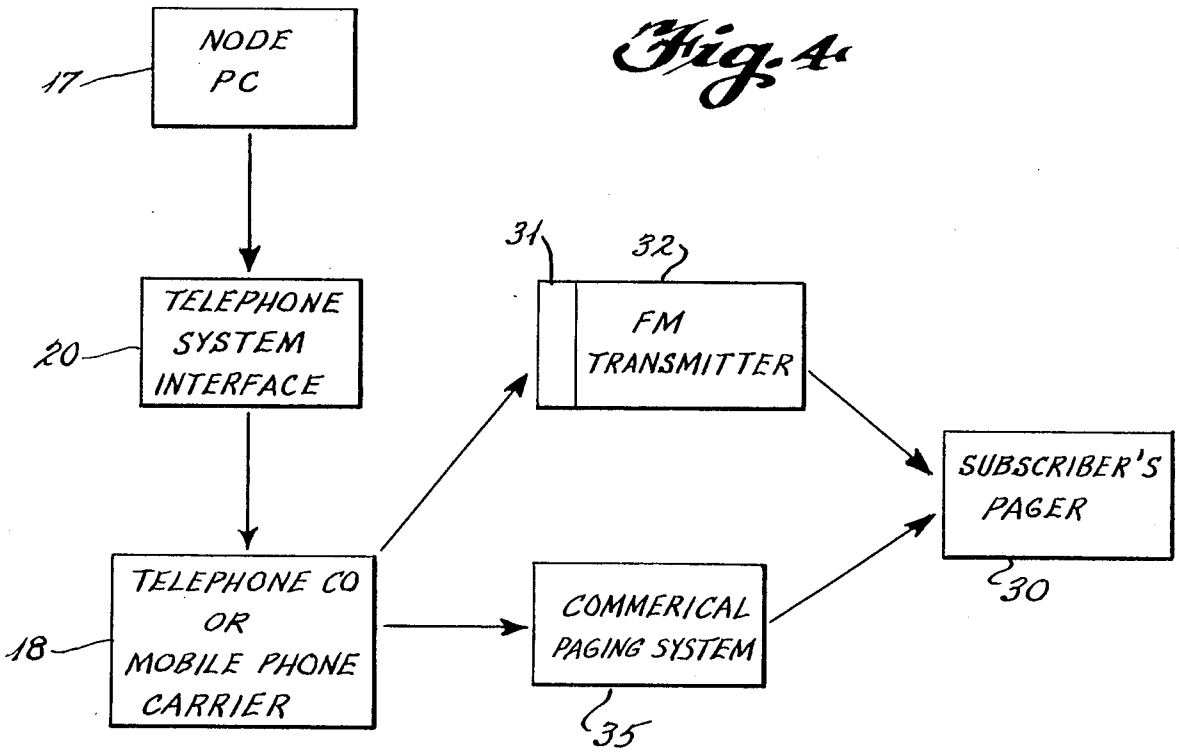
FIG. 4 is a diagram of digital communications transmission links which may be utilized with the present invention to conventional paging devices.

In addition to the foregoing, once a subscriber has accessed the system of the present invention, requested information and updated information may be optionally transmitted to a paging device 30 which is either carried by subscribers or installed within the subscriber's vehicle. With reference to FIG. 4, a flow chart showing alternate digital transmissions to a paging device is disclosed.

After a subscriber's access code has been verified, the subscriber may select to receive various reports or information, including updates, directly by way of a personal paging device 30 by entering proper codes into the node PC 17'. The pagers are alpha numeric devices which can receive and store transmitted digital information for subsequent display to the subscriber. The digital information transmitted is translated into LCD displays, voice playbacks or print messages as desired.

Transmission to a given pager 30 may be accomplished by transmitting a digital signal from the nodes PC 17' via the telephone system interface 20 and telephone carrier 18 to an encoder 31 at an existing FM Transmitter site 32. Alternatively, the transmission from the nodes 17 may be more direct using conventional lasers, microwave or infrared links between the nodes 17 and the encoder for the FM transmitter. The signal received by the encoder 31 will be processed to place it in the necessary form to be modulated on a subcarrier signal of the FM transmitter. Each pager 30 will be tuned to the frequency of the FM station and will be equipped to demodulate the information modulated on the subcarrier signal.

As opposed to an FM subcarrier modulation, information to pagers may be accomplished by transmitting information from the nodes 17 through the telephone system interface and telephone carrier to a commercial paging system 35. From the commercial page systems 35, the information will be transmitted in a conventional manner to a subscriber's paging device.

We claim:

1. An information system for providing traffic information to subscribers by way of telephone and mobile phone communication systems regarding predesignated commuter routes identified by route designation codes where access to the information system is obtained using subscriber access codes comprising, a central data file source for identifying subscribers and for identifying predesignated commuter routes by route designation code , a control terminal means for creating updated traffic information messages, means for transmitting updated traffic information messages from said control terminal means to said central data file source, a telephone system interface means for connecting the information system to the telephone and mobile phone communication systems, at least one node means for receiving telephone transmissions from said interface means, said at least one node means including computer means and analog communication means, said analog communication means being capable of receiving signals from said telephone system interface means and transmitting information to said computer means, siad computer means identifying the subscriber access codes, communication network means disposed between said node means and said central data file source so that information may be transmitted from said central data file source to said computer means of said node means, said computer means and said analog communication means being selectively operable to transmit vocal and digital communication to the subscriber in response to receiving route designation codes which are identified by said computer means and said node means terminating communication in response to the completed transmission of information therefrom to the subscriber.

2. The information system of claim 1 in which said central data file source includes subscriber call back file means for identifying previous subscriber access codes and route designation codes and for comparing updated traffic information messages transmitted from said control terminal means to determine if traffic information changes are reflected relative to such route designation codes, said central data file source communicating the traffic information changes to said computer means, said node means having redial circuit means for contacting a subscriber in response to commands from said central data file source whereby the traffic information changes from said central data file source are transmitted to the subscriber by way of said node means.

3. The information system of claim 2 including route timing file means interconnected with said central data file source for determining whether a subscriber should be contacted dependent upon the amount of time which has lapsed from a subscriber's access concerning the route designation codes.

4. The information system of claim 3 in which said control terminal means includes a voice communication means for receiving voice transmitted messages from an operator.

5. The information system of claim 3 including a plurality of node means that are connected between said telephone system interface means and said central data file source.

6. The information system of claim 5 in which each of said computer means of each of said node means terminates inquiries received through said telephone system interface means in response to receiving erroneous subscriber access codes.

7. The method of providing traffic status along predesignated commuter routings wherein the commuter routings are given route designation codes and wherein a commuter subscriber may access an information system having a control facility by use of a subscriber access code transmitted by way of telephone equipment comprising the steps of:

(a) Compiling information and retaining such information in computer means with regard to traffic conditions along predesignated commuter routings;

(b) Continuously updating information regarding conditions along commuter routings and supplying such information to said computer means;

(c) Permitting access of the subscriber to the information from the computer means by way of verification of a subscriber access code entered through use of the telephone equipment;

(d) Permitting the subscriber to request specific information with regard to specific commuter routings by entering in the route designation codes through the use of the telephone equipment;

(e) Transmission of information through the telephone equipment regarding specific commuter routings to the subscriber from the information system;

(f) Retaining subscriber coded account number and specific commuter routing inquiries for future access;

(g) Releasing the subscriber from the information system.

8. The method of claim 7 in which said transmission of information from the information system is a voice communicated transmission.

9. The method of claim 7 in which said transmission of information from the information system is a digital transmission.

10. The method of claim 7 including the additional steps of:

(h) Continually processing incoming updated file information into the computer means with regard to changes in conditions along the predesignated commuter routings;

(i) Retrieving information regarding subscriber inquiries having specific commuter routings which are affected by change in conditions;

(j) Initiating a communication link with the subscriber and conveying updated file information.

11. The method of transmitting information regarding traveled routes within a geographic area from an information system to telephone subscribers by way of telephone or mobile phone communication links wherein the subscribers are identified by access codes for access to the information system comprising the steps of:

(a) Dividing the geographic area into a plurality of predesignated traveled routes and other areas and predesignating each of said predesignated traveled routes with a unique route designation code;

(b) Collecting traffic information with respect to each each of the predesignated traveled routes and storing such information in computer files which are accessible by the communication links;

(c) Continuously updating the information in the computer files with respect to each of the predesignated traveled routes;

(d) Screening incoming subscriber inquiries to determine proper subscriber access codes;

(e) Acceptance of subscriber inquiry and initiation of subscriber input request for information regarding at least one predesignated traveled route by processing subscriber transmission of route designation code by the communication links;

(f) Automatic transmission of information regarding predesignated traveled routes queried by subscribers from the computer files to the subscribers through the communication links;

(g) Retaining subscriber access numbers and predesignated traveled route inquiries for a predetermined time;

(h) Reviewing computer files for information to determine change of status in a subscriber commuter route inquiry;

(i) Forwarding updated information to a subscriber by way of the communication links if a change in status occurs within said predetermined time concerning a previously queried predesignated traveled route.

12. The method of claim 11 including the additional step of designating the other areas which are not designated by route designation code with a predesignated identification for which information will be collected, accessed and disseminated in the same manner as said predesignated traveled routes.

13. An information system for providing traffic information to subscribers by way of telephone and mobile phone communication systems where access to the information system is obtained using DTMF signal access codes and predesignated route information designation codes comprising, a central data file source for identifying signal access codes and for identifying predesignated route information designation codes, a control terminal means for creating updated traffic information messages, means for transmitting updated traffic information messages from said control terminal means to said central data file source, a telephone system interface means for connecting the information system to the telephone and mobile phone communication systems, at least one node means for receiving telephone transmissions from said interface means, said at least one node means including computer means and voice communication means, said voice communication means being capable of receiving DTMF signals from said telephone system interface means and transmitting information to said computer means, said computer means identifying the access codes, local area network means disposed between said node means and said central data file source for transmitting information from said central data file source to said computer means of said node means, said voice communication means being selectively operable to transmit vocal communication to a subscriber in response to receiving route information designation codes which are identified by said computer means, and said node means terminating communication with said telephone system interface means in response to the completed transmission of information to a subscriber.

14. An information system for providing traffic information to subscribers by way of telephone and mobile phone communication systems regarding predesignated commuter routes identified by route designation codes where access to the information system is obtained using signal access codes comprising, at least one node means having a computer file means and a communication means, said computer file means identifying access codes and predesignated commuter routes by route designation codes, a control terminal means, said control terminal means including means for creating updated traffic information messages, means for transmitting updated traffic information messages from said control terminal means to said computer means, a telephone system interface means for connecting said node means to the telephone and mobile phone communication systems so that said node means receives telephone transmissions from said interface means, communication means being capable of receiving signals from said telephone system interface means and transmitting information to said computer means, said communication means being selectively operable to transmit analog messages to a subscriber and said computer means being selectively operable to transmit digital messages to a subscriber in response to receiving route designation codes which are identified by said computer means, and said node means terminating communication from said information system in response to the completed transmission of information therefrom to the subscriber.

15. The information system of claim 14 including a central data file source for identifying previous subscriber access codes and route designation codes, means for connecting said central data file source to said control terminal means so as to receive updated traffic information messages transmitted from said control terminal means to determine if changes are reflected relative to predetermined commuter routes having route designation codes, network means for communicating updated traffic information messages to said computer means, said communication means having redial capabilities for contacting a subscriber in response to commands from said computer means and thereafter transmitting updated traffic information messages from said computer means to the subscriber.

16. The method of providing traffic status along predesignated commuter routings wherein the commuter routings are given designation codes and wherein a subscriber to the system may access an information system by use of a coded account number transmitted by way of a telephone or mobile telephone system and wherein information from the information system may be transmitted to a subscriber's alpha numeric pager comprising the steps of:

(a) Compiling information and retaining such information in a computer source with regard to traffic conditions along all predesignated commuter routings;

(b) Continuously updating information regarding conditions along commuter routings and supplying such information to the computer source;

(c) Permitting access of a subscriber to the information from the computer source by way of verification of a coded account number transmitted by a telephone or mobile telephone system;

(d) Permitting the subscriber to request specific information with regard to predesignated commuter routings by entering in the designation codes through the use of the telephone or mobile telephone system;

(e) Digital transmission of information regarding requested specific commuter routings to the subscriber to the subscriber's alpha numeric pager;

(f) Retaining subscriber coded account number and specific commuter routing inquiries for future access;

(g) Releasing the subscriber from the information system.

17. The method of claim 16 including the additional steps of:

(h) Continually processing incoming updated file information into the computer source with regard to changes in conditions along the predesignated commuter routings;

(i) Retrieving information regarding subscriber inquiries having specific commuter routings which are affected by change in status;

(j) Initiating a communication link with the subscriber's alpha numeric pager and conveying updated file information.

18. The method of providing traffic status along predesignated commuter routings to subscribers wherein the commuter routings are given designated codes and wherein a subscriber may access an information system having a central computer source and at least one remote node including computer and message transmitting and receiving unit by use of access codes transmitted by way of mobile or other telephones comprising the steps of:

(a) Compiling information and retaining such information in a central computer source with regard to traffic conditions along predesignated commuter routings;

(b) Continuously updating information regarding conditions along the predesignated commuter routings and supplying such information to the central computer source;

(c) Permitting access of a subscriber to the information from the central computer sources by way of verification of an access code received by the computer and message transmitting and recieving unit from signals received from a telephone;

(d) Permitting the subscriber to request specific information with regard to specific commuter routings by entering in designated codes through the use of the telephone;

(e) Transmitting requested specific information with regard to commuter routings entered by the subscriber from the central computer source to the computer and message transmitting and receiving unit;

(f) Voice or digital transmission from the computer and message transmitting and receiving unit of information regarding specific commuter routings to the subscriber;

(g) Retaining subscriber coded account number and specific commuter routing inquiries for future access;

(h) Releasing the subscriber from the information system.

19. The method of claim 18 including the additional steps of:

(h) Continually processing incoming updated file information into the central computer source with regard to changes in conditions along the predesignated commuter routings;

(i) Retrieving information regarding previously entered subscriber requests for specific commuter routings which are affected by change in status;

(j) Initiating communication link from the computer and message transmitting and receiving unit with the subscriber and conveying updated file information.

* * * * *